United States Patent [19]

Ziegenbein

[11] Patent Number: 4,609,122

[45] Date of Patent: Sep. 2, 1986

[54] AUTOMATIC TOUCH ACTUATED DOOR OPENER

[76] Inventor: Keith J. Ziegenbein, Rte. 2, Ashland, Nebr. 68003

[21] Appl. No.: 793,988

[22] Filed: Nov. 1, 1985

[51] Int. Cl.[4] ..... B65D 55/00; B65D 43/24

[52] U.S. Cl. ..... 220/211; 220/1 T; 220/260; 220/335

[58] Field of Search ..... 220/1 T, 260, 254, 211, 220/334, 335

[56] References Cited

U.S. PATENT DOCUMENTS

| | | | |
|---|---|---|---|
| 1,886,490 | 11/1932 | Lynch . | |
| 2,654,117 | 10/1953 | Pattison et al. . | |
| 2,658,231 | 11/1953 | Guttormsen . | |
| 3,219,227 | 11/1965 | Deisner | 220/254 |
| 3,557,133 | 12/1967 | Helsing . | |
| 3,749,274 | 7/1973 | Mele et al. | 220/1 T |
| 3,852,592 | 12/1974 | Scoville et al. | 340/355 |
| 3,891,115 | 6/1975 | Ono | 220/260 |
| 4,205,483 | 6/1980 | Clark et al. | 220/335 |
| 4,375,863 | 3/1983 | Kappler | 220/334 |
| 4,383,721 | 5/1983 | Knaack et al. | 220/335 |
| 4,489,810 | 12/1984 | Curtis | 220/211 |

*Primary Examiner*—George T. Hall

*Attorney, Agent, or Firm*—Zarley, McKee, Thomte, Voorhees & Sease

[57] ABSTRACT

The automatic touch actuated door opener includes an elongated flexible tension member having one end connected to a door and the other end connected to a tension member take-up device. The door is biased to its closed position for maintaining tension in the tension member when the door is moved to its closed position. A switch in contact with the tension member senses decreased tension due to external touching pressure against the door and actuates the take-up device to automatically open the door. A time delay switch causes the take-up device to allow the door to return to its closed position after the preselected time interval.

12 Claims, 6 Drawing Figures

AUTOMATIC TOUCH ACTUATED DOOR OPENER

BACKGROUND OF THE INVENTION

The present invention is directed generally to an automatic power door opener and more particularly to a touch actuated door opener such that touching pressure against a pivoted door will actuate a power source to move the door to its open position. Even more specifically, the invention is directed to a trash housing of the type wherein the cover over an open topped trash receptacle has a swinging access door connected to a touch actuated door opener. Accordingly, when it is desired to dispose of trash in the receptacle, opening pressure against the door causes the automatic door opener to raise the door to its open position, hold for a predetermined time and then allow it to return to the closed position.

In many business establishments and in fast food restaurants in particular, trash receptacles are provided as a housing with a swinging door hinged across the top. It is difficult to dispose of trays of paper cups and food wrappers since the door tends to swing down against the trash preventing it from being easily dumped into the receptacle. It is generally a two-hand operation, one for holding the door open and the other for dumping the trash into the receptacle. A customer carrying a child, briefcase or the like therefore has a very difficult time assisting the establishment by disposing of his trash.

Various types of automatic door openers are known but all have certain limitations. A floor mat actuator for a trash housing door would cause the door to be opened even by passersby. A power opener for a trash housing door could alternately be actuated by an infrared light across the front of the door but the beam could be rendered inoperative by food spilled on the sender or receiver. Furthermore, the infrared actuator would likely require some modification of the housing itself and could be actuated by a customer standing close to the receptacle. The same would be true of other types of presence detectors.

Regardless of the type of actuator, it is undesirable to provide a mechanical linkage to the door which will render the door inoperative if the power unit fails. It is also important that the door be automatically reopened if it is contacted while being closed.

Accordingly, a primary object of the invention is to provide an improved automatic touch actuated door opener.

Another object is to provide a touch actuated door opener for the swinging door of a trash housing.

Another object is to provide a touch actuated door opener which can be easily installed without altering the outside of a trash housing.

Another object is to provide an automatic touch actuated door opener which is usable with virtually any door.

Finally, it is an object to provide an automatic touch actuated door opener which is simple and rugged in construction, inexpensive to manufacture and efficient in operation.

SUMMARY OF THE INVENTION

The automatic touch actuated door opener of the present invention is ideally suited for use in a trash housing for automatically raising the swinging door when it is touched by a hand, food tray or the like. A switch responsive to initial opening movement of the door actuates a power source for swinging the door to its fully open position. A time delay switch associated with the power source allows the door to return to its closed position after a preselected time interval.

The automatic door opener preferably includes an elongated flexible tension member having one end adapted for connection to a door and the other end connected to a tension member take-up device mounted in spaced relation from the door so that the door is moved to its open position in response to actuation of the take-up device. Gravity and/or a biasing device urges the door to its closed position thereby to maintain tension in the tension member when the door is moved to its closed position. A switch in contact with the tension member senses decreased tension due to external pressure against the door and actuates the take-up device to automatically open the door. The above-mentioned time delay switch causes the take-up device to allow the door to return to its closed position after the preselected time interval. It is preferred that adjustable limit switches be incorporated within the door opener for deactivating the power source upon movement of the door to the selected open and closed positions.

DETAILED DESCRIPTION OF THE PREFERRED EMBODIMENT

Figure 1:
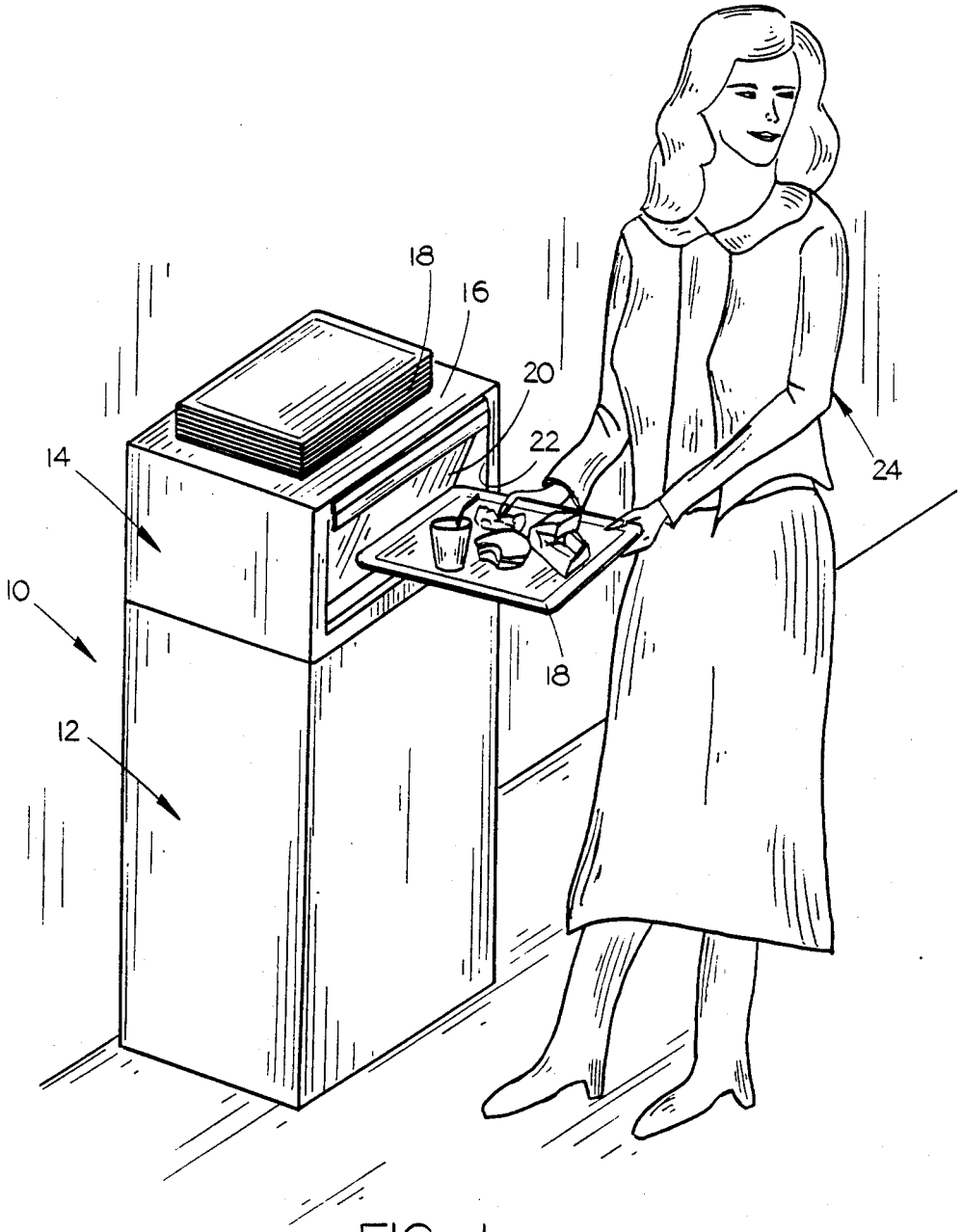
FIG. 1 is a perspective view of a fast food restaurant trash container showing a tray contacting the door for actuating the opener.

In FIG. 1, there is shown a trash housing 10 which includes an open-topped trash receptacle 12 and an attractive matched cover housing 14. The cover housing 14 has a flat top surface 16 for the storage of trays 18. A swinging door 20 is hingedly mounted in a front opening 22 for providing access to the trash receptacle 12. As is described hereinbelow, swinging door 20 will be automatically opened when it is contacted by a food tray 18, as shown in FIG. 1, or by the hand of the customer 24.

Figure 2:
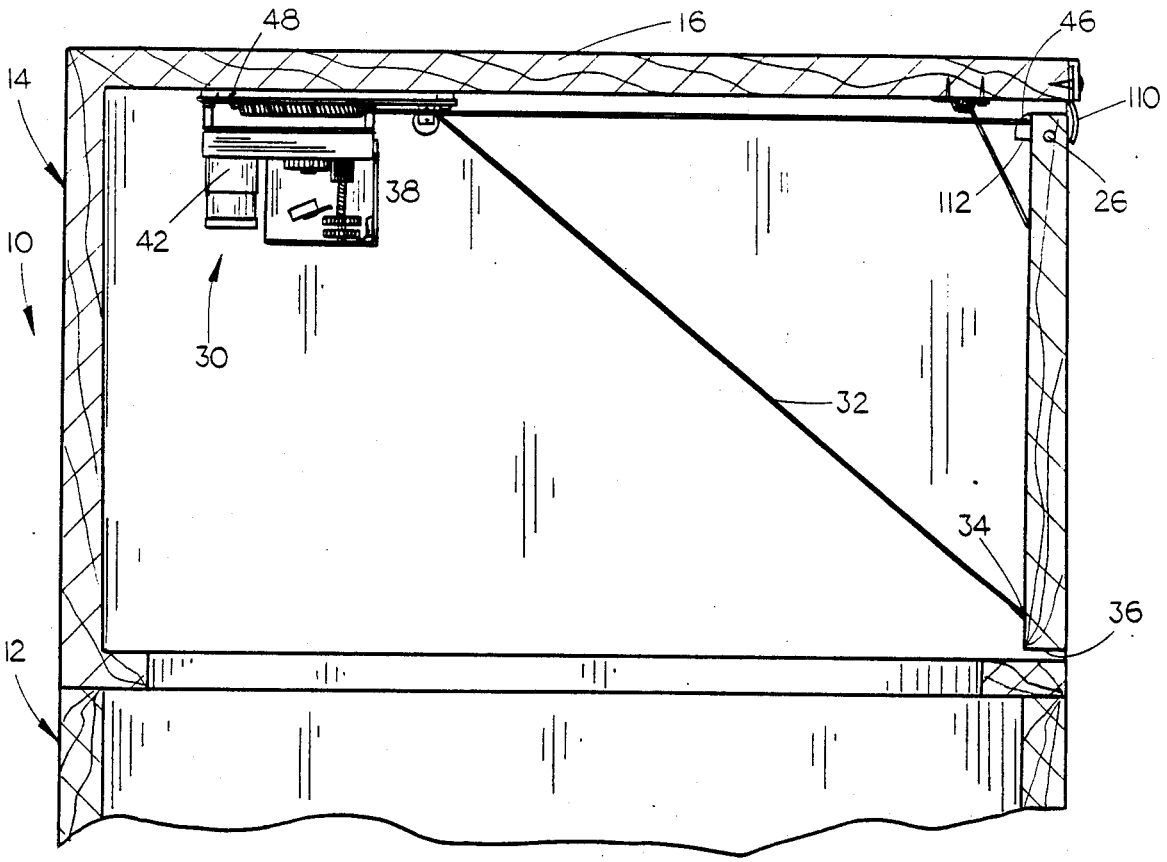
FIG. 2 is an enlarged side-sectional view showing the door opener mechanism and the door in a closed position.
Figure 3:
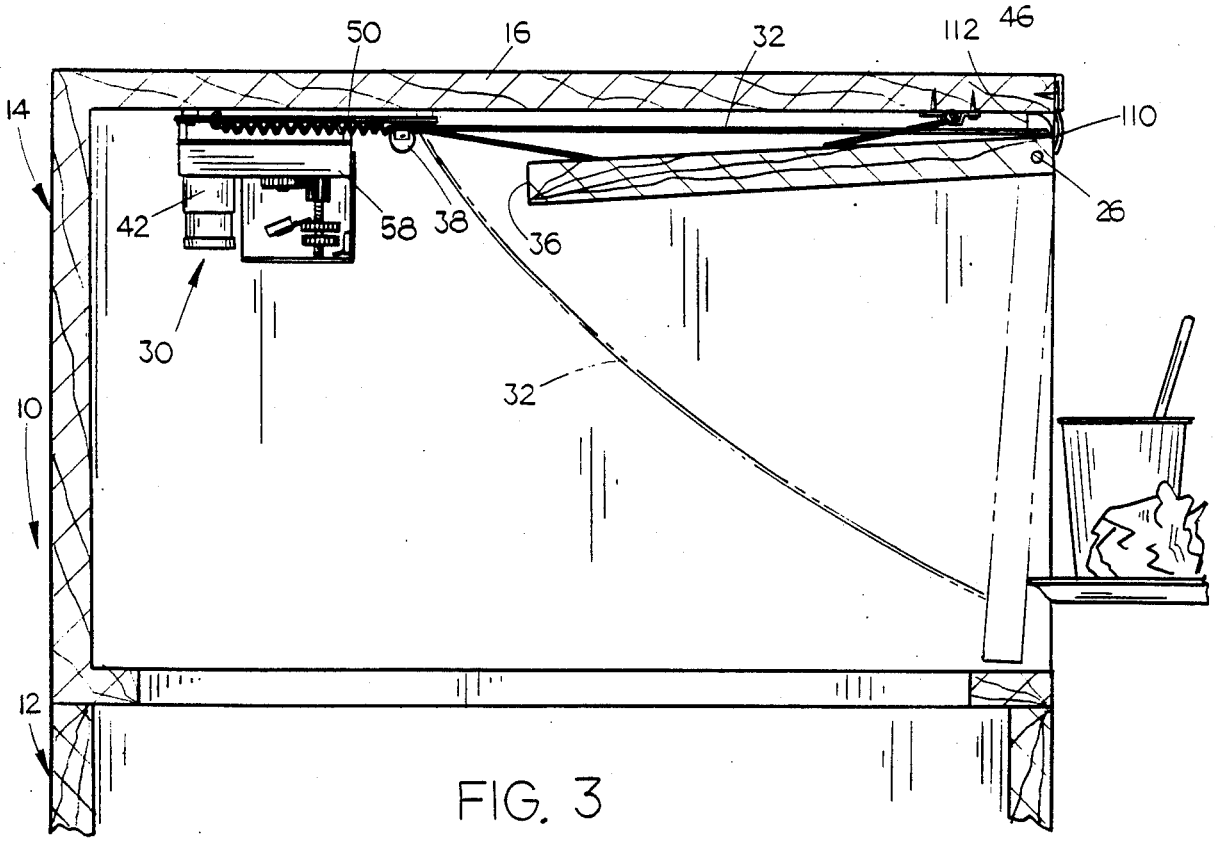
FIG. 3 is an enlarged side-sectional view showing the door opener mechanism and the door in the open position thereof.

FIGS. 2 and 3 show that door 20 is hingedly mounted for pivotal movement about an axis 26 adjacent the top of the door. The door 20 is pivotally moveable between the closed position of FIG. 2 and open position of FIG. 3.

The automatic door opener 30 of the invention is shown as mounted on the interior side of top wall 16 close to the free end of the door in its open position. Door opener 30 includes an elongated flexible tension member or cable 32 having one end 34 connected to the door 20, preferably adjacent the free end 36 thereof. A cable is trained over an idler pulley 38 and around a take-up pulley 40 which is rotatable by a motor 42 to take up the cable 32 and thereby pivot door 20 upwardly to the open position. A time delay switch described hereinbelow allows the door to return to its closed position at a predetermined time after movement of the door to the open position. Door 20 is biased to its closed position by the gravitational weight of the door. In addition, a torsion spring 44 is mounted on the interior side of top wall 16 adjacent the upper end of swinging door 20. Spring 44 has a depending biasing arm 46 which engages the door and urges it in a pivotal direction toward the closed position of the door. It is apparent that the torsion spring 44 could be replaced by a tension spring, a compression spring and rod mechanism, a door weight or the like for biasing the door to its closed position.

Actuation of motor 42 is effective by touching pressure against the front of door 20, as illustrated in FIG. 3. Food tray 18 is shown pressed against the door 20 to swing it slightwardly inwardly. The decreased tension in cable 32 is sensed by the door opener for actuating the motor 42 to automatically raise the door.

Figure 4:
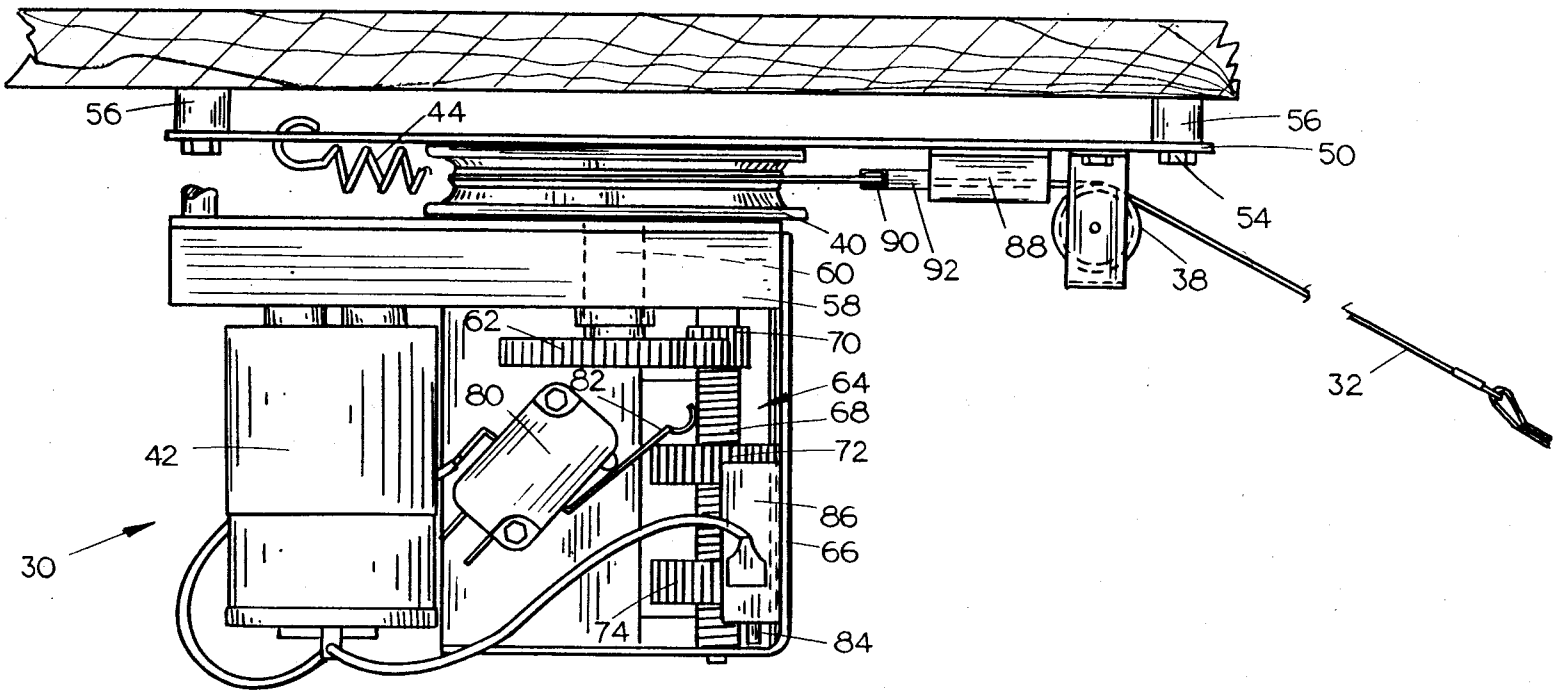
FIG. 4 is a further enlarged detail side view of the door opener mechanism.
Figure 5:
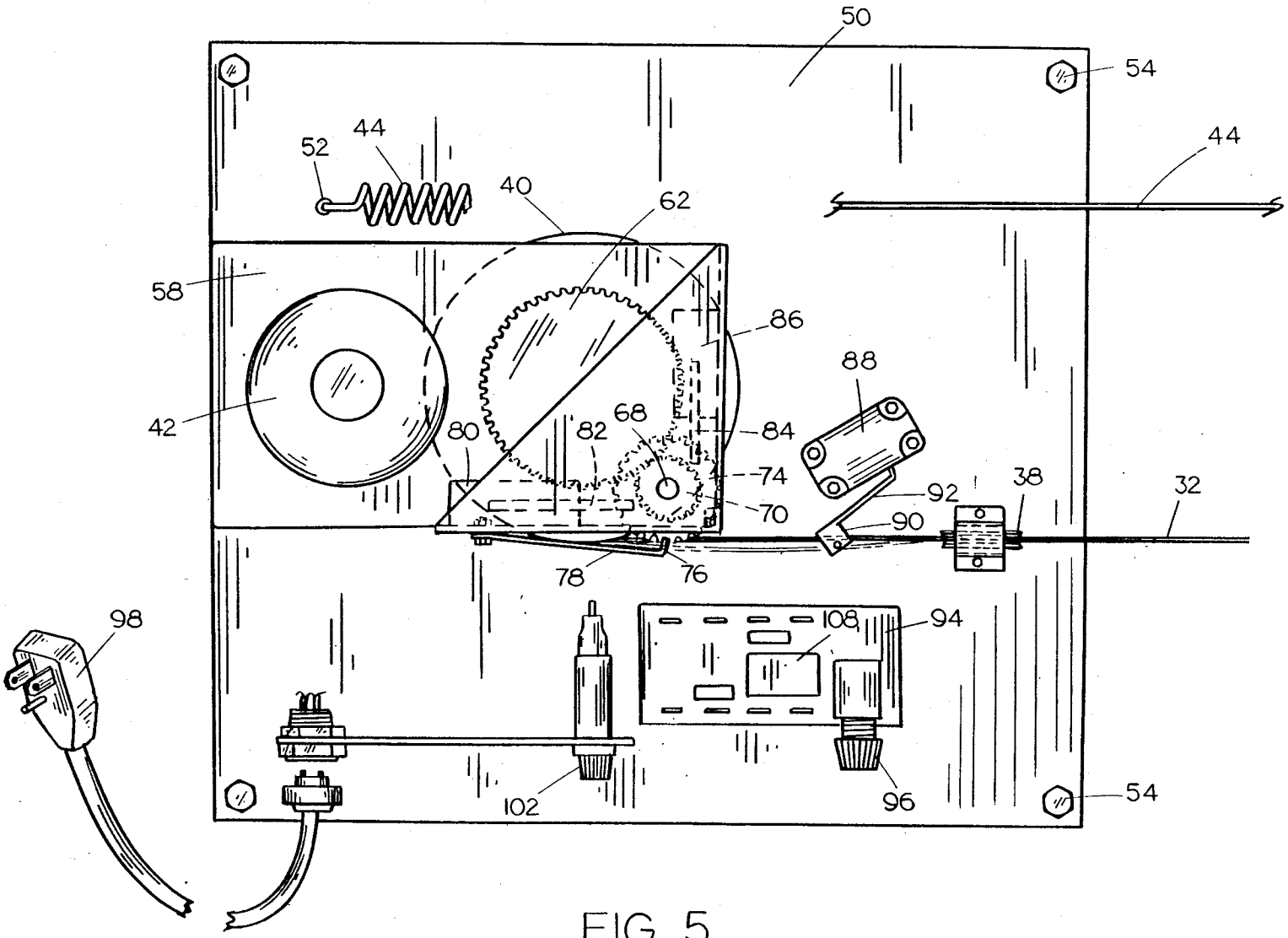
FIG. 5 is a bottom plan view of the door opener mechanism.

A preferred configuration for the automatic door opener 30 is shown in FIGS. 4 and 5. The mounting plate 50 is secured by screws 54 and spacers 56 to the cover housing top wall 16. It could alternately be secured to the rear wall or side walls but the illustrated position is preferred for simplicity and balance.

The take-up pulley 40 is rotatably sandwiched between the mounting plate 50 and gear transfer case 58. It is preferred that there be practically zero clearances on either side of the pulley to prevent the cable from wrapping around the pulley shaft 60 when tension on the cable is relaxed. Motor 42 is preferably provided as a reversible electric motor to thereby control both the opening and closing movement of the door 20. The gear transfer case 58 drivingly connects the motor to the output shaft 60 which carries the take-up pulley 40 on one side of the transfer case and a primary drive gear 62 for a limit switch mechanism 64 on the other side of the transfer case.

Limit switch mechanism 64 is carried within a housing 66 depending from transfer case 58. An externally threaded shaft 68 is rotatably supported between the housing 66 and transfer case 58 at a position with a fixed driven gear 70 in meshed relation with primary drive gear 62. A pair of wheels 72 and 74 are threadably mounted on shaft 68 and each gear is provided with axially directed external gear teeth adapted for engagement by the turned up flange 76 of spring plate 78 for preventing rotation of the wheels except when being adjusted. Accordingly, the wheels 72 are moved axially of shaft 68 in response to rotation of the shaft. A first limit switch 80 is mounted on housing 66 with an actuator 82 extended into the path of first wheel 72 such that, upon opening of the swinging door 20, first wheel 72 is moved in an upward vertical direction as shown in FIG. 4. Upon engagement with actuator arm 82, limit switch 80 is tripped to deactivate motor 42. When the motor is reactivated by the time delay switch for lowering the door, the second wheel 74 is caused to move downwardly on shaft 68 to the extent of engagement with the actuating arm 84 of a second limit switch 86 for again deactivating motor 42. As shown in FIG. 5, flange 76 of spring plate 78 may be manually pulled away from the wheels 72 and 74 for threadably adjusting the position of the wheels on the shaft for adjusting the desired stopping positions of the door 20 in its open and closed positions.

Initial activation of the automatic door opener 30 is effected by a tension-sensitive switch 88 shown in FIG. 5 between idler pulley 38 and take-up pulley 40. Cable 32 is trained through a roller-less actuator 90 on the end of actuator arm 92. Switch 88 is so positioned that tension in cable 32 forces the actuator arm toward the switch for closing the switch. When pressure is exerted against the front of the swinging door 20, tension in cable 32 is relaxed with the result that the internal biasing force on switch actuator arm 92 causes the tension-sensitive switch 88 to be opened for actuating motor 42.

Figure 6:
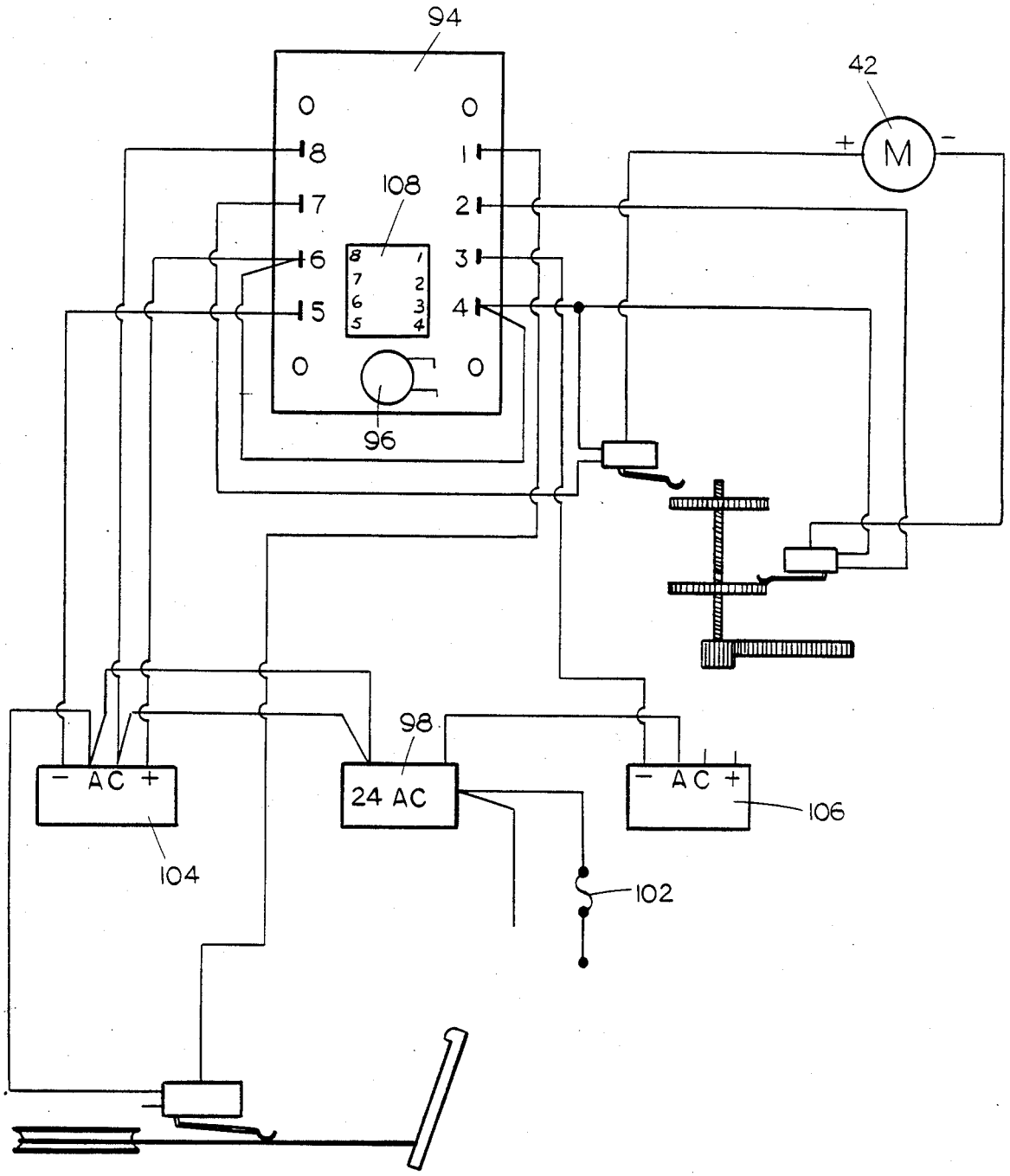
FIG. 6 is an electrical diagram for the door opener mechanism.

The operation of the automatic door opener 30 will be described in connection with the electrical circuit diagram of FIG. 6. Again, touching pressure against swinging door 20 relaxes tension in cable 32. This is detected by tension-sensitive switch 88 which acts through the printed circuit board 94 to activate motor 42 in a direction to raise swinging door 20. As the door reaches its open position, first wheel 72 of limit switch mechanism 64 strikes the first limit switch 80 to deactivate the motor 42. A potentiometer 96 on circuit board 94 effects a time delay prior to reactivation of motor 42 in the opposite direction for lowering swinging door 20. As the door returns to its closed position, second wheel 74 of limit switch mechanism 64 strikes second switch 86 to again deactivate motor 42. Accordingly, this completes one opening and closing cycle of the automatic door opener 30.

If the door is contacted during its closing movement, it is apparent that tension in cable 32 will be relaxed. This will be sensed by switch 88 which causes the automatic door opener 30 to recycle thereby immediately reopening the door and holding it open prior to automatic closing.

Power may be supplied from a standard 110 volt wall outlet to a plug in type transformer 98. A one-quarter amp circuit braker 102 is provided as shown. Transformer 98 directs a 24 volt output through a bridge rectifier 104 for operating motor 42 at increased speed during raising movement of the door, as compared to 12 volt power directed through bridge rectifier 106 for slowing down the motor during closing movement of the door. The slower closing movement is not as surprising to a customer unfamiliar with the device.

In the circuit, circuit board 94, which includes relay 108, is commercially available from SSAC Manufacturing Company in New York as part number ORM24A22. Other details of the preferred embodiment relate to the cable 32 which may be provided as a 49 strand stainless steel 3/64 inch cable which is plastic coated to a 1/16th inch outside diameter. It is preferred that the cable be flexible for live action of the tension sensitive switch 88. It is preferred that the sensitivity be such that up to ¼, and preferably 1/32nd inch movement of the cable in response to pressure on the door will cycle the opener 30.

The automatic door opener 30 is compact and could be easily installed on existing trash housings. It is usable on virtually any door and does not require that the outside surface of the trash housing be modified in any way. The swinging door in fact shields the door opener from contact with refuse being placed in the receptacle so as to eliminate any sanitation problems.

FIGS. 1, 2 and 3 show that the top edge of the swinging door may be covered by a protective flexible strip 110 and that a quarter-round strip 112 on the back side of the door 20 at the upper edge furthermore prevents the insertion of fingers between the door and top edge of the housing opening for safety.

Whereas a preferred embodiment of the invention has been shown and described herein, it is apparent that many modifications, additions and substitutions may be made which are within the intended broad scope of the appended claims. For example, a limit switch mechanism 64 could be replaced by a cog tooth counter for the main drive gear or by other suitable mechanisms. The time delay potentiometer may be replaced by a fixed resistor for a preset preferred 6 second time delay interval. For use on outside trash housings, electrical power may be provided by a gel battery and solar collector.

Thus these has been shown and described an automatic touch actuated door opener which accomplishes at least all of the stated objects.

I claim:

1. In combination, a trash housing comprising a trash receptacle and a cover therefor, said cover including a swinging door movable between closed and open positions and biased to the closed position thereof.

an automatic touch actuated door opener comprising, power means drivingly connected to said door and actuatable for moving the door to open position thereof, means responsive to initial opening movement of the door for actuating said power means to move said door to the open position thereof.

2. The combination of claim 1 further comprising time delay means associated with said power means for allowing said door to return to the closed position thereof at a predetermined time after movement to the open position thereof.

3. The combination of claim 2 wherein said door is supported for pivotal movement about a generally horizontal axis at a position such that the weight of the door biases the door to the closed position thereof.

4. An automatic touch actuated door opener adapted for opening a door mounted for movement between open and closed positions and biased to the closed position thereof, comprising an elongated flexible tension member having one end adapted for connection to the door, tension member take-up means operatively connected to said tension member and actuatable to take up said tension member, means for mounting said tension member take-up means in spaced relation from a door whereby said door is moved to the open position in response to actuation of the take-up means, and switch means in contact with said tension member and operatively connected to the take-up means, said switch means being responsive to decreased tension in said tension member for actuating said take-up means to take up the tension member for moving the door to the open position thereof.

5. The automatic door opener of claim 4 further comprising biasing means connectable to the door for biasing said door to the closed position thereof thereby to maintain tension in the tension member in response to movement of the door to the closed position.

6. The automatic door opener of claim 5 further comprising time delay switch means associated with said take-up means for allowing said door to return to the closed position thereof by said biasing means at a predetermined time after movement of the door to the open position thereof.

7. The door opener of claim 4 wherein said tension member comprises an elongated cable.

8. The door opener of claim 4 wherein said take-up means comprises a pulley connected to the tension member for reeling in and paying out the tension member in response to rotation of the pulley in opposite direction, a motor and means drivingly connecting the motor to the pulley.

9. The door opener of claim 8 wherein said motor comprises a reversible electric motor actuatable for rotating said pulley in opposite directions.

10. The door opener of claim 9 further comprising limit switch means operatively connected to the motor for deactivating the motor in response to movement of the door to the open and closed positions thereof.

11. The door opener of claim 10 wherein said limit switch means comprises an externally threaded shaft drivingly connected to said motor for rotation in unison with said pulley, a pair of wheels threadably carried on said shaft, releasable means for securing said wheels against rotation whereby rotation of said shaft effects an axial movement of said wheels, and a pair of limit switches mounted for engagement by a respective one of said wheels in response to movement of the door to the respective open and closed positions.

12. The door opener of claim 11 further comprising an idler pulley for supporting said cable at a position in spaced relation from said main pulley, said switch means contacting the cable between said idler pulley and main pulley.

* * * * *